US005438342A

United States Patent [19]

Yamaguchi

[11] Patent Number: 5,438,342

[45] Date of Patent: Aug. 1, 1995

[54] LIQUID CRYSTAL DISPLAY APPARATUS AND METHOD AND APPARATUS FOR DRIVING SAME

[75] Inventor: Hidefumi Yamaguchi, Fujisawa, Japan

[73] Assignee: International Business Machines Corporation, Armonk, N.Y.

[21] Appl. No.: 883,090

[22] Filed: May 15, 1992

[30] Foreign Application Priority Data

May 15, 1991 [JP] Japan ..... 3-138666

[51] Int. Cl.[6] ..... G09G 3/30

[52] U.S. Cl. ..... 345/58; 345/96

[58] Field of Search ..... 340/784, 805, 811; 345/58, 79, 96, 54, 98, 99, 100, 87

[56] References Cited

U.S. PATENT DOCUMENTS

| | | | |
|---|---|---|---|
| 4,945,352 | 7/1990 | Ejiri | 345/58 |
| 5,061,920 | 10/1991 | Nelson | 340/784 |
| 5,093,655 | 3/1992 | Tanioka et al. | 340/805 |
| 5,115,232 | 5/1992 | Iizuka | 340/784 |
| 5,122,790 | 6/1992 | Yasuda et al. | 345/209 |
| 5,155,476 | 10/1992 | Shioji | 340/784 |
| 5,274,366 | 12/1993 | Hayashi et al. | 345/96 |

FOREIGN PATENT DOCUMENTS

| | | | |
|---|---|---|---|
| 2159314 | 11/1985 | European Pat. Off. . | |
| 0371665 | 6/1990 | European Pat. Off. | 345/209 |
| 433054 | 6/1991 | European Pat. Off. . | |

*Primary Examiner*—Jeffery Brier
*Assistant Examiner*—A. Au
*Attorney, Agent, or Firm*—David Aker; Ronald L. Drumheller

[57] ABSTRACT

A method and an apparatus for driving a liquid crystal display, in which flicker and cross talk are removed for arbitrary display patterns. The liquid crystal display has a plurality of scan lines, a plurality of data lines, and a plurality of pixels arranged in a matrix at the intersections of the scan and the data lines. The polarity of data signals outputted to the data lines is inverted for each occurrence of a pixel to be placed into a predetermined state. The predetermined state may be a dark state or a bright state of a binary display, or one of several levels of a display having more than two gray scale levels.

19 Claims, 6 Drawing Sheets

LIQUID CRYSTAL DISPLAY APPARATUS AND METHOD AND APPARATUS FOR DRIVING SAME

FIELD OF THE INVENTION

The present invention relates to liquid crystal displays using active elements. More particularly, it relates to the problem of producing a liquid crystal display which is free of flicker and cross talk that affect the quality of screen images on the liquid crystal display (herein after also called an I.CD). It also relates to a method for driving the LCD and a drive apparatus that produces a display image free of flicker and cross talk.

BACKGROUND ART

In a conventional active-matrix type LCD using a liquid crystal panel, the polarity of data signals outputted to data lines is inverted for each frame to drive liquid crystal elements with alternating current to prevent deterioration in the properties of the liquid crystal display. However, it is known that if the polarity is inverted for each frame, flicker is produced in the image since the voltage which must be applied to a liquid crystal changes depending upon whether the polarity is positive or negative for a frame. To solve this problem, an active-matrix type LCD to which AC drive is applied, uses a method for driving the liquid crystal display based on an electric signal of a polarity different for each data line (that is, each column within the same panel) or a method for driving the liquid crystal based on an electric signal of a polarity different for each scan line (that is, each row within the same panel). An LCD using the driving method in which polarity is inverted for each column is disclosed by, for example, Japanese Published Unexamined Patent Application (PUPA) No.61-275822. An LCD using the driving method in which polarity is inverted for each row is disclosed by, for example, Japanese PUPAs No.61-275823 and No. 62-218943. The method in which polarity is inverted for each row reduces flicker, but involves a problem in that variation in the electric potential of a common electrode of the pixels causes cross talk. The method in which the polarity is inverted for each column has the effect of reducing both flicker and cross talk. However, even if the method is applied, some display patterns may produce flicker and cause cross talk. The construction of an LCD using the method for driving it in which polarity is inverted for each column and the problems associated with it are described below.

FIG. 1 shows the general construction of an LCD using the method for driving it in which polarity is inverted for each column. A gate driver 1 outputs scan signals to n scan lines G1 to Gn. A first data driver 2 is connected to odd data lines $D_1$ to $D_{m-1}$ to which first data signals are outputted. A second data driver 3 is connected to even data lines $D_2$ to $D_m$ to which second data signals of opposite polarity to that of the first data signals are outputted. TFTs 4 are provided at the respective intersections of the scan lines and data lines, each one of their gate electrodes being connected to a corresponding one of the scan lines, each one of their drain electrodes being connected to a corresponding one of the data lines, and their respective source electrodes being connected to a corresponding one of the pixel electrodes 5 of a liquid crystal cell described below.

The drive operations, set forth below, are described with reference to FIG. 1. Gate signals are sequentially applied to each gate electrode of the TFTs 4, connected to each scan line, by a gate driver I, in response to control signals from a controller (not shown), and the TFTs 4 are sequentially turned on. First data signals and second data signals are applied to respective data lines simultaneously with the gate signals, from the first data driver 2 and the second data driver 3, respectively. The first and the second data signals have opposite polarity. The polarities are inverted for each frame.

Thus, as described above, the first and the second data signals are of opposite polarity. Further, all pixels on the display screen are driven by alternating current so as to be inverted for each data line.

In the conventional LCD, as described above, since the pixels are inverted and driven by alternating current for each data line, flicker and cross talk may be suppressed to some extent, but some display patterns may still cause flicker and cross talk. For example, if each pixel is repeatedly displayed in an on-off pattern of 101010 . . . , flicker occurs since a pixel turned on in one scanning direction is driven by a pulse of the same polarity, even if the pixels are driven by alternating current so as to be inverted for each data line. Further, if the pixel is driven in one scanning direction as described above, a problem exists in that variation in the electric potential of the common electrodes of the pixels causes cross talk.

SUMMARY OF THE INVENTION

It is an object of the present invention to provide a liquid crystal display free from the occurrence of flicker and cross talk irrespective of the display pattern.

It is a further object of the invention to provide a method For driving and a drive apparatus For a liquid crystal display that eliminates both flicker and cross talk.

The method For driving the liquid crystal display apparatus of the present invention is characterized in that in a liquid crystal display apparatus having a plurality of scan lines, a plurality of data lines, and a plurality of pixels arranged in a matrix at the intersections of the scan and data lines, the polarity of data signals outputted to the data lines is inverted for each occurrence of a pixel to be placed into a predetermined state.

The liquid crystal display apparatus of the present invention is characterized in that it comprises a plurality of scan lines, a plurality of data lines, a plurality of pixels arranged in a matrix at the intersections of the scan and data lines, and a data driver for receiving a digital data signal represented by a predetermined number of bits and for outputting a data signal to the data lines to drive the pixels. The pixels are driven by alternating current based on a polarity signal for controlling the polarity of the data signals outputted to the data lines. A polarity signal inverting means inverts said polarity signal each time the digital data signal represented by the predetermined number of bits becomes one predetermined state of multiple states, so that the polarity of the data signals outputted to the data lines for each occurrence of a pixel to be placed into a predetermined state is inverted.

The drive apparatus of the liquid crystal display, in accordance with the invention is characterized in that, in a liquid crystal display comprising a plurality of scan lines, a plurality of data lines, a plurality of pixels arranged in a matrix at the intersections of the scan and data lines, and a data driver for receiving a digital data signal represented by a predetermined number of bits and for outputting a data signal to the data lines to drive the pixels, the drive apparatus controls the polarity of data signals outputted to the data lines based on a polarity signal so as to drive the liquid crystal display with alternating current. A polarity signal inverting means inverts the polarity signal each time the digital data signal represented by the predetermined number of bits becomes one predetermined state of multiple states so as to invert the polarity of the data signals outputted to the data lines for each occurrence of a pixel to be placed in a predetermined state.

DETAILED DESCRIPTION OF THE PREFERRED EMBODIMENTS

Figure 2:
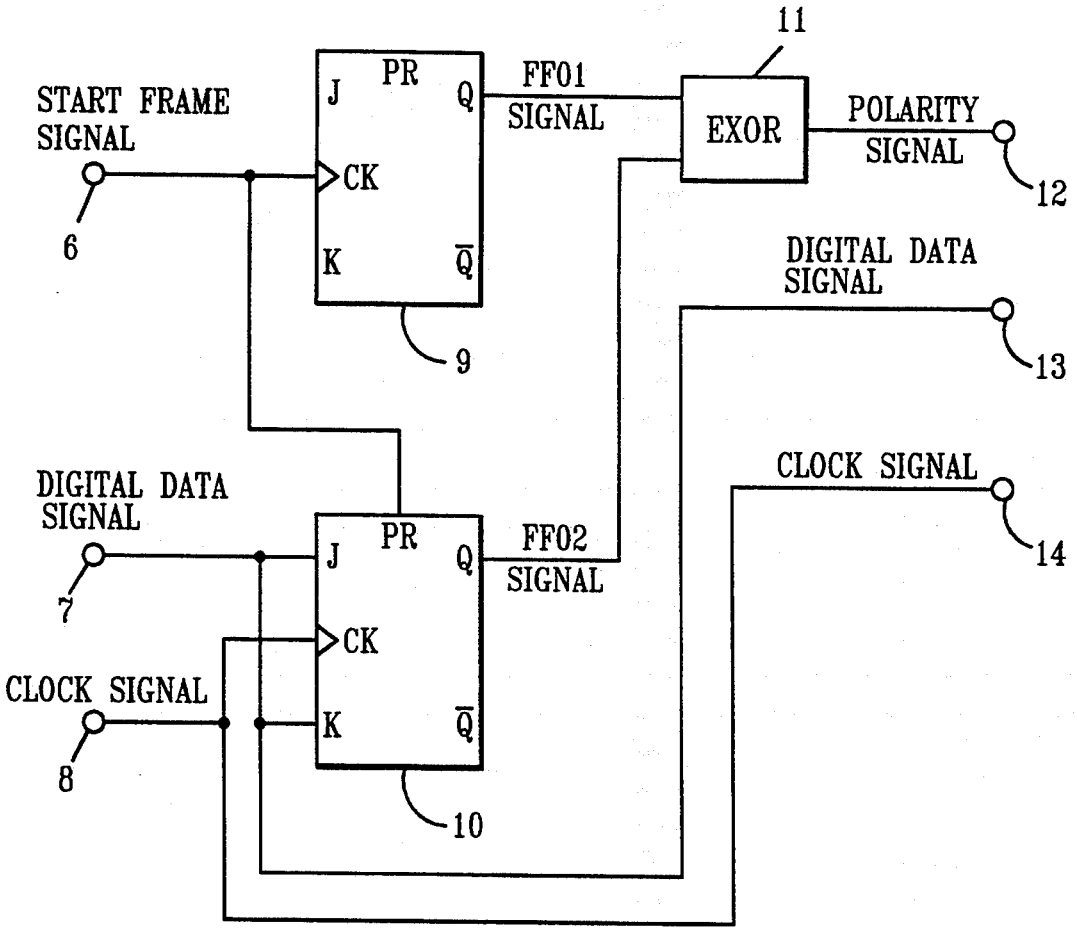
FIG. 2 is a schematic diagram of a drive apparatus according to the present invention.

FIG. 2 illustrates an embodiment of an LCD driver for a binary display in accordance with the present invention. By binary, it is meant that only two levels are displayed (white and black). An input 6 for a start frame signal is connected to a CK terminal of a first J-K flip-flop 9 to which the start frame signal is applied and a preset PR terminal of a second JK flip-flop 10. An input 7 for a digital data signal to which a one-bit digital data signal is inputted, is connected to a terminal and a K terminal of the second JK flip-flop 10 and an output 13 for the digital data signal. An input 8 for a dock signal is connected to a CK terminal of the second J-K flip-flop 10 to which a clock signal is applied, and to an output 14 for the clock signal. The Q terminal of the first J-K flip-flop 9 and the Q terminal of the second I-K flip-flop 10 are connected to a first input and a second input of an exclusive OR gate EXOR 11, respectively. An output of the exclusive OR gate I1 is connected to an output 12 for a polarity signal. Output signals directed to these three outputs are supplied to a data driver 2 (shown in FIG. 3 and FIG. 6). The data driver 2 outputs a certain data signal to the data lines based on conditions of the digital data signal and the polarity signal.

Figure 1:
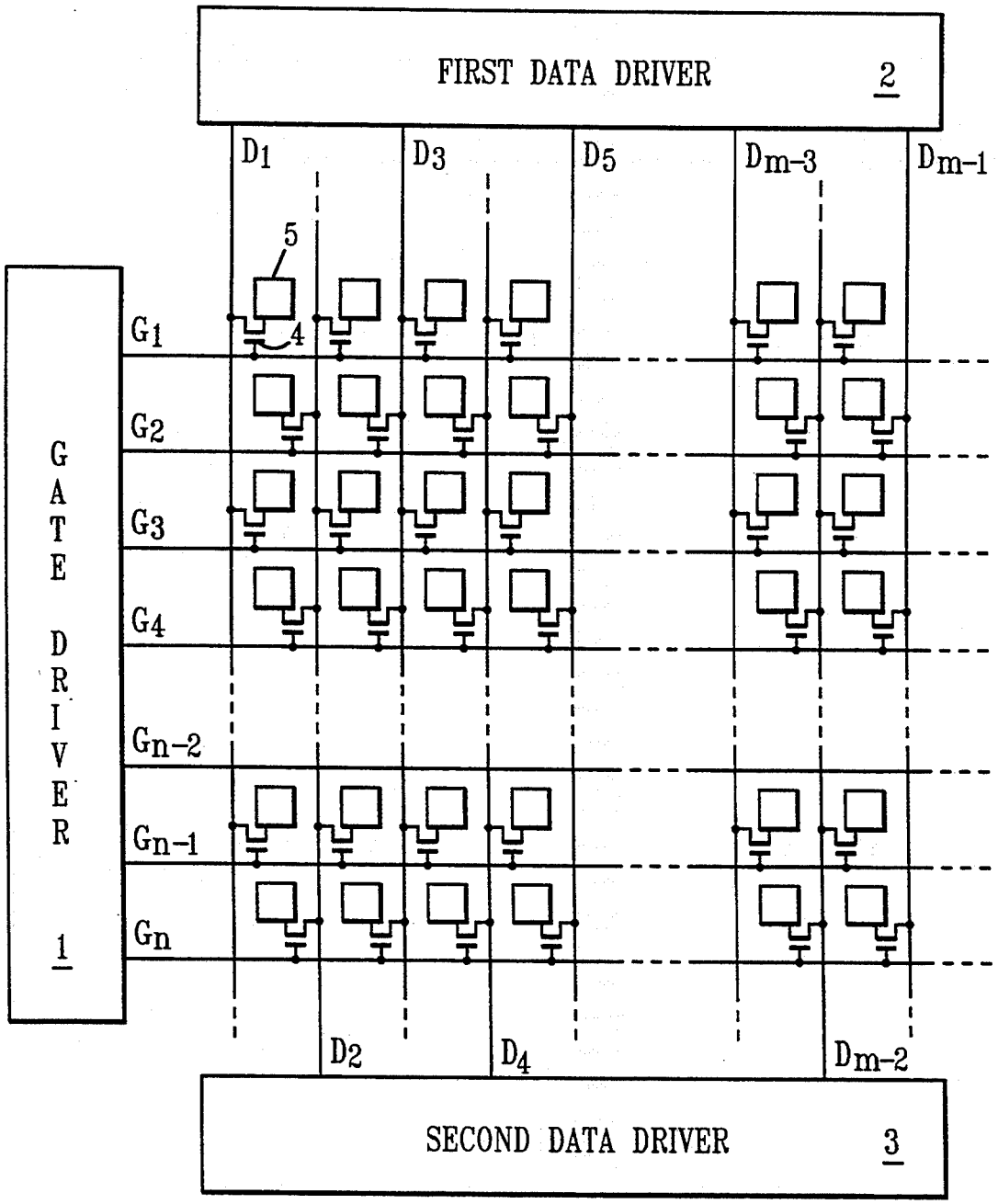
FIG. 1 PRIOR ART
FIG. 1 is a schematic diagram of a conventional LCD.
Figure 3:
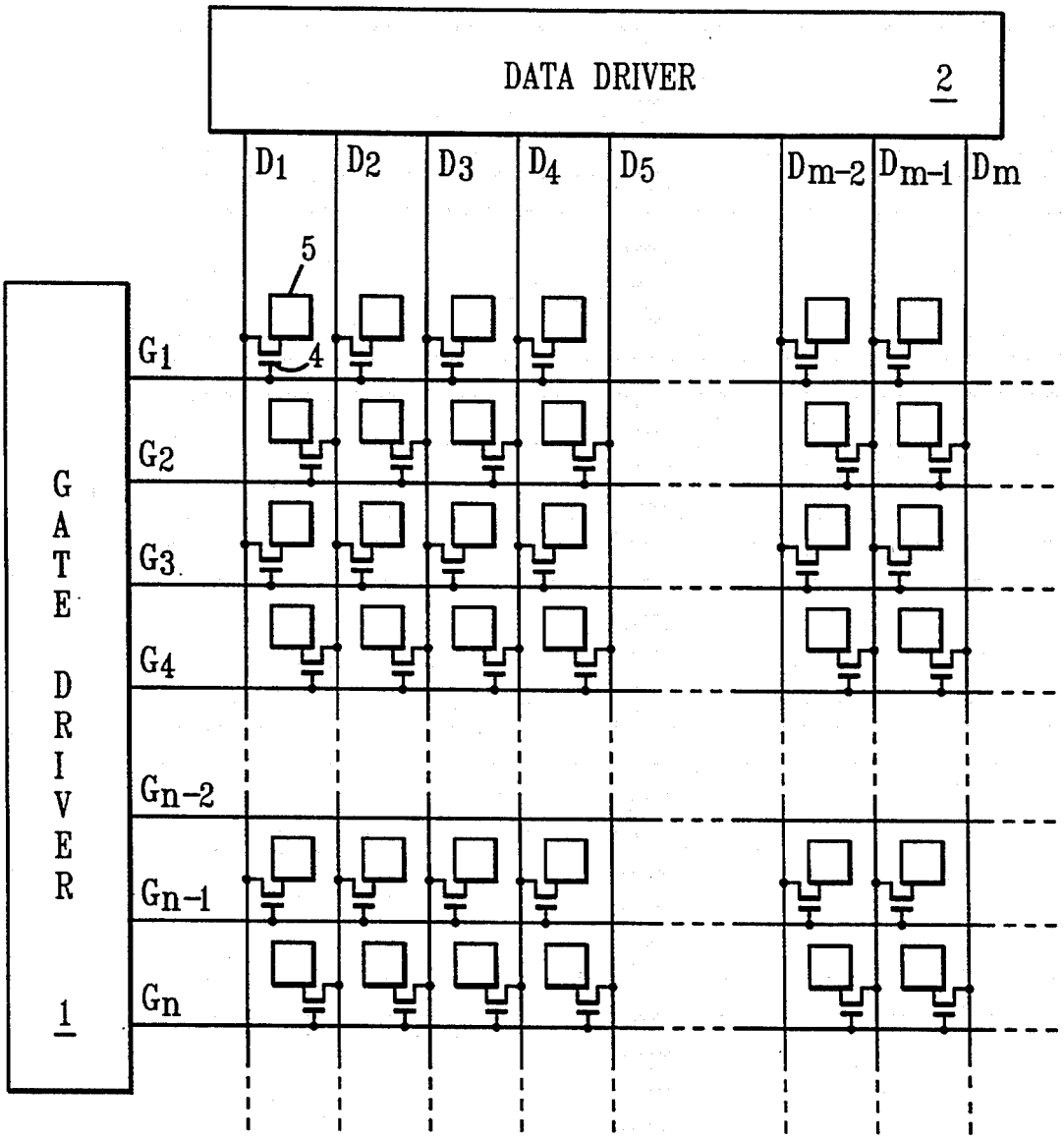
FIG. 3 is a schematic diagram of an LCD in which the drive method in accordance with the present invention may be used.

FIG. 3 shows an embodiment of an LCD constructed according to the present invention. For the LCD shown in FIG. 1, the data lines of the liquid crystal panel are divided into two groups and are driven by two data drivers provided on the upper and the lower sides. However, for the LCD of FIG. 3, all data lines of the liquid crystal panel are driven by one data drive.

In the LCD as shown in FIG. 3, scanning signals supplied from a gate driver 1 are sequentially applied to scan lines G1 to Gn. Every TFT 4 connected to any scan line is thereby turned on sequentially. Simultaneously with the scantling signals from the gate driver 1, a data signal corresponding to a digital data signal for display is outputted to data lines $D_1$ to $D_m$ from a data driver 2. If an attempt to display a certain row in a display pattern such as 101110 . . . is made, for normally white mode, a data signal which causes a pixel to be placed into the dark state is outputted from the data driver 2 in response to a digital data signal of, for example, "1". For normally black mode, a data signal which causes a pixel to be placed into tile bright state, is outputted from the data driver 2 in response to a digital data signal of, for example, "1". In other words, in any mode, the data signals are the signals actually used to apply an electric field to a liquid crystal pixel.

Figure 4:
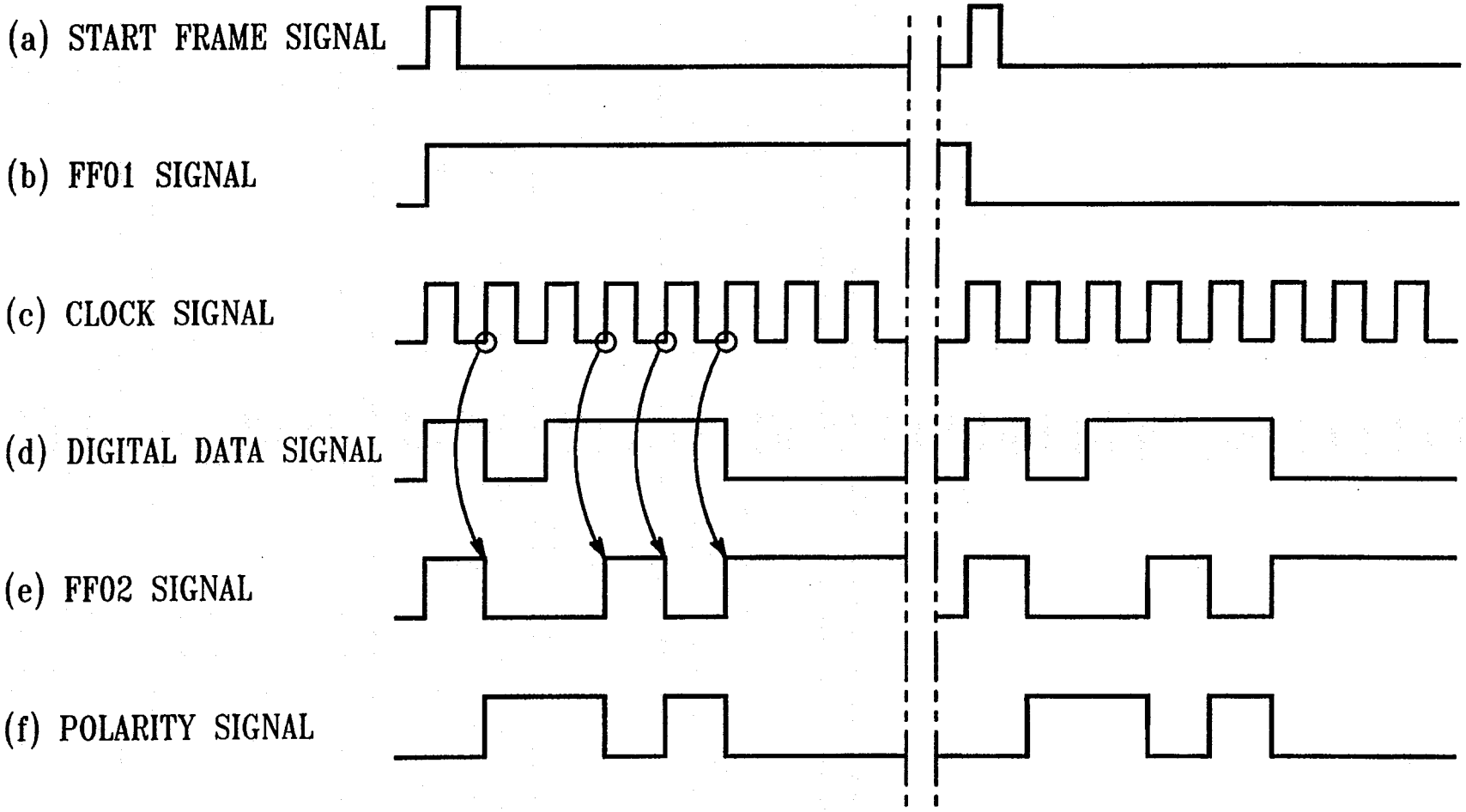
FIG. 4 showing waveforms (a) to (f) are timing charts illustrating operation of the circuit of FIG. 2.

Operation of tile circuit shown in FIG. 2 of an embodiment according to the present invention is described. Reference is also made to FIG. 4 which illustrates the waveforms of timing signals in each part of the circuit of FIG. 2.

When a start frame signal shown in FIG. 4 waveform(a) is supplied to the input 6, an output signal from the first J-K flip-flop 9 is inverted at the rising edge of the start frame signal and a FF01 signal shown in FIG. 4 waveform (b) is directed to its Q terminal. One-bit digital data signals "1", "0", "1", "1", "1", "0", . . . , shown in FIG. 4 waveform (d) are supplied to the J and the K terminals of the second J-K flip-flop 10 and a clock signal (refer to FIG. 4 waveform (c)) and the start frame signal are supplied to the CK and the preset terminals PR, respectively. In this presetting, a signal from the Q terminal of the second J-K flip-flop 10 is always set, as shown in FIG. 4 waveform (e) to logical "1" at its beginning. The state signal, which is an output signal, that is, the FF02 signal from the second J-K flip-flop 10 is inverted at the rising edge of the clock signal each time tile clock signal is inputted during tile application of the digital data signal "1" (refer to FIG. 4 waveform (e)). The FF02 signal is thus set to logical "1", "0", "0", "1", "0" . . . The FF01 (refer to FIG. 4 waveform (b)) described above and the FF02 (refer to FIG. 4 waveform (e)) signals thus obtained are inputted to the exclusive OR gate 11 where a logical operation is applied to both signals. A resulting polarity signal of logical "0", "1", "1", "0", "1" shown in FIG. 4 waveform (f) is supplied to the output 12.

Figure 6:
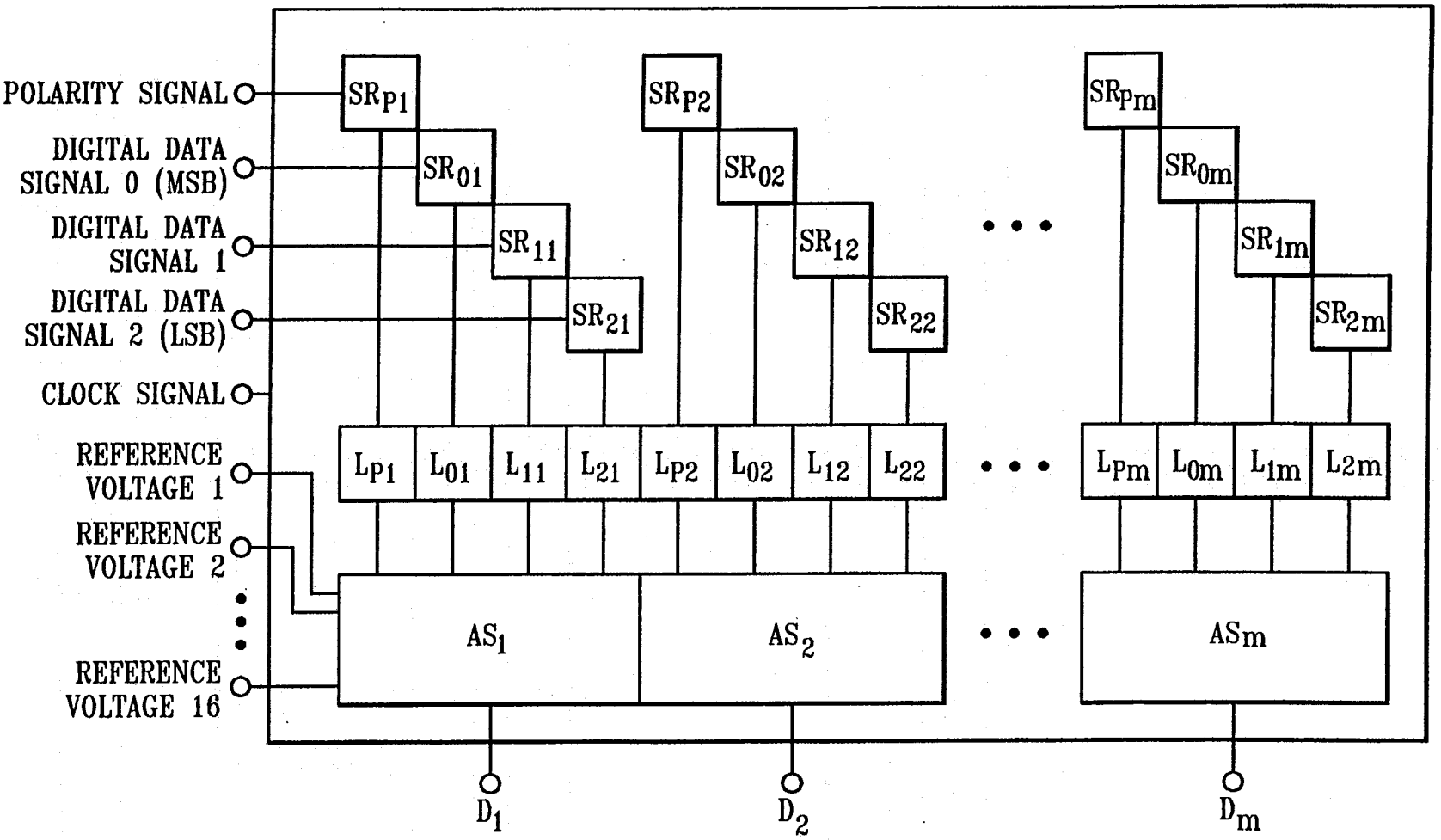
FIG. 6 is a block diagram of the data driver of FIG. 3.

Based on the polarity signal thus obtained and the digital data signal, the data driver 2 shown in FIG. 3 and FIG. 6 output,,; predetermined data signals to the data lines. The circuit of FIG. 2 causes the polarity of the data signals outputted from the data driver 2 to be inverted only if the digital data signal is in a predetermined state, for example, it is 1. Therefore, in normally white mode, the polarity of the data signals is inverted for each occurrence of a pixel to be placed into the dark state. However, in normally black state, the polarity of the data signals is inverted for each occurrence of a pixel to be placed into the bright state. As is obvious from the above, according to the circuit of FIG. 2, even if a pixel to be placed into the dark state in normally white mode (or the bright state in normally black mode) occurs every other data line, the polarity of the data signals is inverted and flicker is removed. Further, with respect to a pixel to be placed into the dark state in normally white mode (or the bright state in normally black mode) within all pixels in one scanning direction, the number of data signals of positive polarity becomes equal to that of data signals of negative polarity and thereby cross talk can be reduced in the horizontal direction.

In the above embodiment, the first and the second flip-flops 9 and 10 are of the J-K type. However, it will be recognized that any type flip-flop may be used if it has the same function as that of the J-K type.

In the above embodiment, the exclusive OR gate is used as a circuit for a logical operation. However, it will be appreciated that any other circuit may be used if it has the same logical function as that of the exclusive OR gate.

Figure 5:
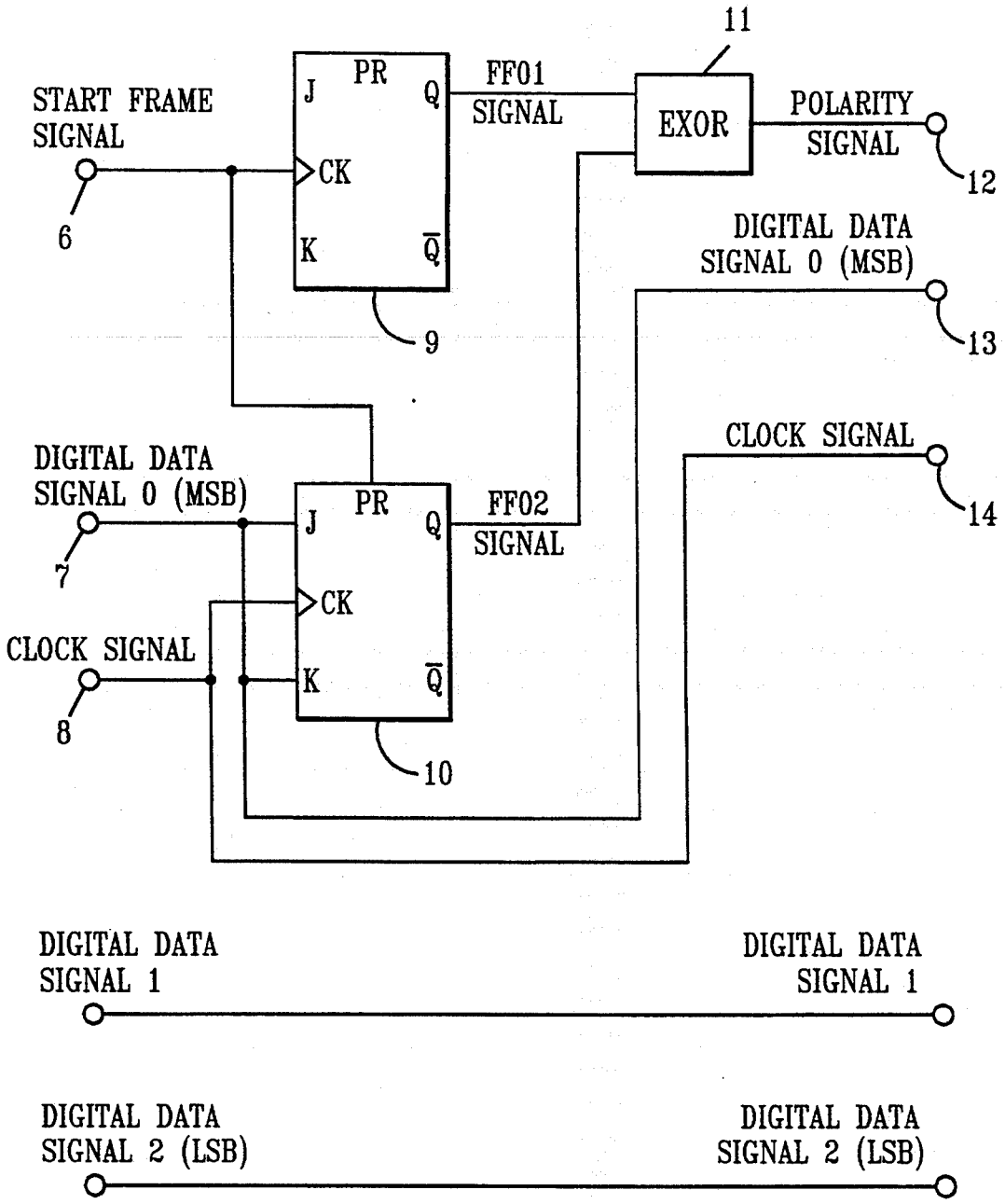
FIG. 5 is a schematic diagram of an additional embodiment of the drive apparatus according to the present invention.

An embodiment of an LCD for gray scale display according to the present invention is described below. In this embodiment, the digital data signal described above is represented by two or more bits. FIG. 5 shows an example in which a 3-bit digital data signal is used. Referring to FIG. 5, bit 0, which is a most significant bit of the digital data signal, is supplied to the input 7. Other bits are inputted to the data driver 2 without change. According to the circuit of FIG. 5, for each occurrence of a pixel to be placed into the darkest state in normally white mode (or a pixel to be placed into the brightest state in normally black mode), the polarity of the data signals outputted from the data driver 2 is inverted. It will be understood that a logical combination of all bits of the digital data signal may be supplied to the input 7. For example, bit 0 to bit 2 of a three-bit digital data signal are inputted to an OR gate. Then the resultant value may be supplied to the input 7. In this way, each time a pixel to be placed into any one of multiple dark states in normally white mode (or a pixel to be placed into any one of multiple bright states in normally black mode) occurs, the polarity of the data signals outputted from the data driver 2 can be inverted. Such a logical combination of multiple bits of the digital data signal can be selected at will, as necessary.

FIG. 6 shows an example of a data driver which outputs predetermined data signals to data lines based on input of a polarity signal and a digital data signal obtained as a result of the application of the present invention. The example of FIG. 6 shows a three-bit digital data signal. The data driver comprises shift registers SR, latches L, and switches AS. Each switch AS supplies one of the reference voltages to its respective data line. For example, switch AS, supplies one of the reference voltages I through 16 to data line $D_1$ as a function of the combination of the polarity signal, digital data signal 0, digital data signal 1, and digital data signal 2 which are shifted by shift registers $SR_{p1}$, $SF_{01}$, $SR_{11}$, and $SR_{21}$ and latched by latches $L_{p1}$, $L_{01}$, $L_{11}$ and $L_{21}$, respectively. In the example, since 4 bits are used, including one bit of the polarity signal, four m-bit shift registers are needed if the number of data lines is m. Further, since gray scale consists of 8 levels including a reference level (white level in normally white, or black level in normally black), a total of 16 reference voltages 1 to 16 for 8 levels of positive polarity and 8 levels of negative polarity are needed. The same reference voltages may be used for reference levels of positive polarity and negative polarity. Thus, the number of reference voltages can be decreased to 15. If a digital data signal is represented by one bit, that is, in a binary display, similarly 4 or 3 reference voltages are needed (if the same reference voltage is used for reference levels of positive polarity and negative polarity).

It will be understood that the method of the present invention may be used along with a method which inverts the polarity of data signals For each scan line, that is, for each row. In this way, flicker and cross talk can be even more completely removed.

The present invention, as described above, has an advantage in that the polarity of the data signals outputted to the data lines is inverted for each occurrence of a pixel to be placed into a predetermined state and thus flicker and cross talk can both be removed, at the same time, even for special display patterns.

While the invention has been described in connection with specific embodiments, it will be understood that those with skill in the art may be able to develop variations of the disclosed embodiments without departing from the spirit of the invention or the scope of the following claims.

What is claimed is:

1. A method for driving a liquid crystal display apparatus that includes a plurality of scan lines, a plurality of data lines, a plurality of pixels arranged in a matrix at the intersections of said scan lines and said data lines and a driver for driving the data lines with a data signal representing successive pixel states and at a polarity determined by a polarity signal, said polarity signal having a polarity value representing one of two different polarity values for each of said successive pixel states, wherein the improvement comprises the step of:

changing said polarity value of said polarity signal for each occurrence of a predetermined pixel state.

2. The method of claim 1, wherein said predetermined pixel state is representative of a dark state of a pixel in a normally white mode of operation.

3. The method of claim 2, wherein each pixel has only two states and said dark state is one of said two states.

4. The method of claim 2, wherein said predetermined pixel state is representative of one of several states of a gray scale of said liquid crystal display apparatus.

5. The method of claim 1, wherein said predetermined pixel state is representative of a bright state of a pixel in a normally black mode of operation.

6. The method of claim 5, wherein each pixel has only two states and said bright state is one of said two states.

7. The method of claim 5, wherein said predetermined pixel state is representative of one of several states of a gray scale of said liquid crystal display apparatus.

8. A liquid crystal display apparatus comprising:

a plurality of scan lines;

a plurality of data lines;

a plurality of pixels arranged in a matrix at intersections of said scan lines and said data lines;

a data driver for receiving a digital data signal representing successive pixel states each by a predetermined number of bits and for outputting a data signal to said data lines to drive said pixels, said data driver providing data signals of alternating polarity to said data lines in accordance with a polarity signal, said polarity signal having a polarity value representing one of two different polarity states for each of said successive pixel states; and means for creating said polarity signal so as to change said polarity value each time a predetermined one of said number of bits representing a successive pixel state has a predetermined value, whereby the polarity of the data signals outputted to said data lines is inverted for each occurrence of a pixel state in which said predetermined one of said number of bits representing said pixel state has said predetermined value.

9. The liquid crystal display apparatus according to claim 8, wherein said pixels are bright when not driven and wherein said predetermined value corresponds to a dark pixel state.

10. The liquid crystal display apparatus according to claim 8, wherein said pixels are dark when not driven and wherein said predetermined value corresponds to a bright pixel state.

11. The liquid crystal display apparatus according to claim 8, wherein said predetermined number of bits is at least two.

12. The liquid crystal display of claim 8 wherein said means for creating said polarity signal comprises:

a first logic means having a clock input and a data output, a second logic means having a clock input, a preset input, a data input and a data output, means for providing a start frame signal to the clock input of said first logic means and to the preset input of said second logic means, means for providing a clock signal to said clock input of said second logic means, means for providing an input signal to said data input of said second logic means, and a third logic means having first and second inputs and an output, said data output of said first logic means being connected to said first input of said third logic means and said data output of said second logic means being connected to said second input of said third logic means, said output of said third logic means corresponding to an exclusive OR condition of said first input and said second input of said third logic means.

13. The liquid crystal display of claim 12 wherein the first logic means and the second logic means are flip-flops.

14. The liquid crystal display of claim 12 wherein said means for providing an input signal provides a most significant bit of said digital data signal.

15. The liquid crystal apparatus according to claim 8, wherein said predetermined number of bits is one.

16. A liquid crystal display apparatus comprising:

a plurality of scan lines;

a plurality of data lines;

a plurality of pixels arranged in a matrix at intersections of said scan lines and said data lines;

a data driver for receiving a digital signal representing successive pixel states each by a predetermined number of bits and for outputting a data signal to said data lines to drive said pixels;

driving means for driving the liquid crystal display apparatus with alternating current wherein the polarity of said data signal outputted to said data lines is controlled in accordance with a polarity signal, said polarity signal having a polarity value representing one of two different polarity states for each of said successive pixel states; and means for creating said polarity signal so as to change said polarity value each time a predetermined one of said number of bits representing a successive pixel state has a predetermined value.

17. The liquid crystal display of claim 16 wherein said means for creating said polarity signal comprises:

a first logic means having a clock input and a data output, a second logic means having a clock input, a preset input, a data input and a data output, means for providing a start frame signal to the clock input of said first logic means and to the preset input of said second logic means, means for providing a clock signal to said clock input of said second logic means, means for providing an input signal to said data input of said second logic means, and a third logic means having first and second inputs and an output, said data output of said first logic means being connected to said first input of said third logic means and said data output of said second logic means being connected to said second input of said third logic means, said output of said third logic means corresponding to an exclusive OR condition of said first input and said second input of said third logic means.

18. The liquid crystal display of claim 17 wherein the first logic means and the second logic means are flip-flops.

19. The liquid crystal display of claim 17 wherein said means for providing an input signal provides a most significant bit of said digital data signal.

* * * * *